US008464388B2

(12) United States Patent
Chen

(10) Patent No.: US 8,464,388 B2
(45) Date of Patent: Jun. 18, 2013

(54) MULTI-FUNCTION BRUSH FOR OVERDENTURE

(76) Inventor: Ming Sheh Chen, Taipei (TW)

( * ) Notice: Subject to any disclaimer, the term of this patent is extended or adjusted under 35 U.S.C. 154(b) by 211 days.

(21) Appl. No.: 13/050,208

(22) Filed: Mar. 17, 2011

(65) Prior Publication Data

US 2012/0144612 A1 Jun. 14, 2012

(30) Foreign Application Priority Data

Dec. 13, 2010 (TW) ..... 99224140 U

(51) Int. Cl.
*A46B 9/04* (2006.01)
*A46B 5/02* (2006.01)

(52) U.S. Cl.
USPC ..... 15/106; 15/143.1; 15/167.1; D4/104; D4/105; D4/106

(58) Field of Classification Search
USPC ..... 15/106, 160, 167.1, 143.1; D4/104–106, D4/119–120, 138
See application file for complete search history.

(56) References Cited

U.S. PATENT DOCUMENTS

| | | | | | |
|---|---|---|---|---|---|
| 1,813,076 | A | | 7/1931 | Newell | |
| 2,190,277 | A | | 2/1940 | Viragh | |
| 2,206,542 | A | * | 7/1940 | Arnold | 15/106 |
| 2,511,235 | A | | 6/1950 | Arwood | |
| D162,941 | S | * | 4/1951 | Ehrman | D4/108 |
| D213,669 | S | * | 4/1969 | Miller | D4/106 |
| 5,383,244 | A | * | 1/1995 | Ahrens et al. | 15/106 |
| 5,465,449 | A | | 11/1995 | Lewkowicz | |
| 5,934,762 | A | | 8/1999 | Vrignaud | |

FOREIGN PATENT DOCUMENTS

| | | | |
|---|---|---|---|
| DE | 4225546 A1 | | 2/1994 |
| EP | 880917 | * | 12/1998 |
| FR | 2558355 | * | 7/1985 |
| GB | 19408 A | | 0/1897 |
| JP | 10-155548 | * | 6/1998 |
| JP | 2003-204975 | * | 7/2003 |
| WO | 94/05183 | * | 3/1994 |
| WO | 9920150 A1 | | 4/1999 |

* cited by examiner

*Primary Examiner* — Mark Spisich
(74) *Attorney, Agent, or Firm* — Rabin & Berdo, P.C.

(57) ABSTRACT

A multi-function brush for an overdenture includes a brush handle having a head end and a tail end. The head end has a first surface and a second surface opposite to the first surface. The first group of brushes is provided on the first surface of the head end. The second group of brushes is provided on the second surface of the head end. The third group of brushes is provided on the tail end. With these three groups of brushes having different locations, specifications and indications, an overdenture user can clean the tissue surface and the denture surface of the overdenture, the male part of the dental attachments provided on the tissue surface, and the female part of the dental attachments provided on alveolar ridge or roots by this single brush. Thus, the present invention really has convenience and practicability, and the money for buying different toothbrush and denture brush is saved.

5 Claims, 6 Drawing Sheets

MULTI-FUNCTION BRUSH FOR OVERDENTURE

BACKGROUND OF THE INVENTION

1. Field of the Invention

The present invention relates to a brush, in particular to a multi-function brush for overdenture patients care.

2. Description of Prior Art

With the remarkable advance in dental technology, various dentures are developed to replace missing teeth in an oral cavity of a patient. In general, dentures are divided into two categories: fixed dentures and removable dentures. A fixed denture is one that is permanently fixed to a tooth roots in the oral cavity by cement or fixed to dental implants by screws and bolts. A removable denture is one that is removably overlay to tooth roots in the oral cavity, so that the patient wearing a removable denture can take this denture out of the oral cavity or put is back based on his/her need. The removable dentures are further divided into two categories. A removable single denture and/or complete denture is worn by a patient who is missing all teeth in maxillary arch and/or mandibular arch. If some of the selected tooth roots remain in the oral cavity and some designed dental implants are implanted in the selected locations, such a removable denture is called a removable overdenture.

The construction and maintenance of the removable overdenture are more complicated than those of the removable complete denture. First, it has to verify whether the remaining tooth root of the patient is still usable. If the tooth root is unusable, an artificial root (i.e., implant fixture) has to be implanted into the oral cavity at a position where diagnosis and design indicated, thereby replacing the tooth root and providing support, retention and stability to the overdenture. Next, the overdenture is fabricated by acrylic resin to match the profile of an oral anatomical foundation of the patient. One surface of the overdenture which is brought into direct contact with the roots and residual alveolar ridge in the oral cavity is called the tissue surface, and the other surface of the overdenture is called the denture surface. The denture surface is divided into an occlusal surface with a profile of white denture teeth and an acrylic resin surface with a profile of missing alveolar bone and connective tissue.

In order to secure the overdenture to the residual natural root or implanted artificial root, a female part of dental attachment is first fabricated into the residual root or the implant root. Then, the tissue surface of the overdenture is provided with a male part of dental attachment. The connection between the male and the female parts of the dental attachment makes the overdenture to be firmly retained and supported by the attachment and stabilized at the oral cavity. The connection between the male and the female dental attachment can be achieved by engagement between a casted female element and a nylon male element or pre-fabricated magnetic attraction between two magnetic bodies. In addition, the splinting of separated implant fixtures at the same arch requires a casted metal tissue bar.

According to the above, it is apparent that the cleaning of the overdenture involves a step of cleaning the denture surface and the tissue surface, a step of cleaning the male dental attachments and the female dental attachments, and a step of cleaning the residual roots or implant roots in the residual ridges. Furthermore, the overdenture, the dental attachments and the roots have different cleaning demands. Especially, unlike the tissue surface and the denture surface of the overdenture that are both made by resin, the connective tissue adjacent to natural roots or artificial roots is still of vital tissue and thus cannot be cleaned by the rigid brushes for cleaning the acrylic resin. Thus, it is necessary to use another semi-tufted brushes to clean the vital connective tissue adjacent to the natural roots or the artificial roots. Further, the user cannot see the positions of the natural roots or artificial roots clearly, and some roots are even located near molar teeth in the posterior areas of the oral cavity. Thus, the brushes for cleaning the connective tissue and roots in the oral cavity have to be designed more carefully. As a result, the user often needs to buy two different brushes. One is used to clean the overdenture outside the mouth, and the other is used to clean the connective tissue and natural or artificial roots inside the mouth, which causes the inconvenience in use and increase in money.

Therefore, in order to solve the above-mentioned problems, the present inventor proposes a novel and practicable multi-function brush which can be used inside or outside the mouth, all within one single brush.

SUMMARY OF THE INVENTION

The present invention relates to a multi-function brush for an overdenture, whereby the user can clean the tissue surface and the denture surface of the overdenture extra-orally. The user also can clean the male parts of the dental attachment extra-orally. The female parts of the dental attachment and connective tissue adjacent to the roots can be cleaned intra-orally.

The present invention provides a multi-function brush for an overdenture, including:

a brush handle having a head end and a tail end counter to the head end, the head end having two surface brushes opposite to each other, that is, a first surface and a second surface opposite to the first surface;

a first group of brushes provided on the first surface of the head end;

a second group of brushes provided on the second surface of the head end; and a third group of brushes provided on the tail end.

In comparison with prior art, the present invention has the following advantageous features.

According to the present invention, the first group of brushes is provided on the head end and has the largest area, which is used to clean a denture surface (including the occlusal surface and any resin surface) of the overdenture. The second group of brushes is provided on the surface of the head end opposite to the first group of brushes, which is used to clean the tissue surface of the overdenture and male part of the dental attachments provided on the tissue surface. The third group of brushes is provided on the tail end, which is used to clean natural roots or artificial roots located in residual alveolar ridge of an oral cavity and female part of the dental attachments provided on the roots. In other words, according to the present invention, three groups of brushes having different locations and indications are provided. Therefore, the user can clean the denture surface and the tissue surface of the overdenture, the male part of the dental attachments provided on the tissue surface, and the female parts of dental attachments provided on roots by this single brush. Thus, the present invention really has convenience and practicability. Further, the user needs not to buy two different brushes for cleaning the overdenture, dental attachments and the connective tissue adjacent to the natural or artificial roots, so that the money is saved.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
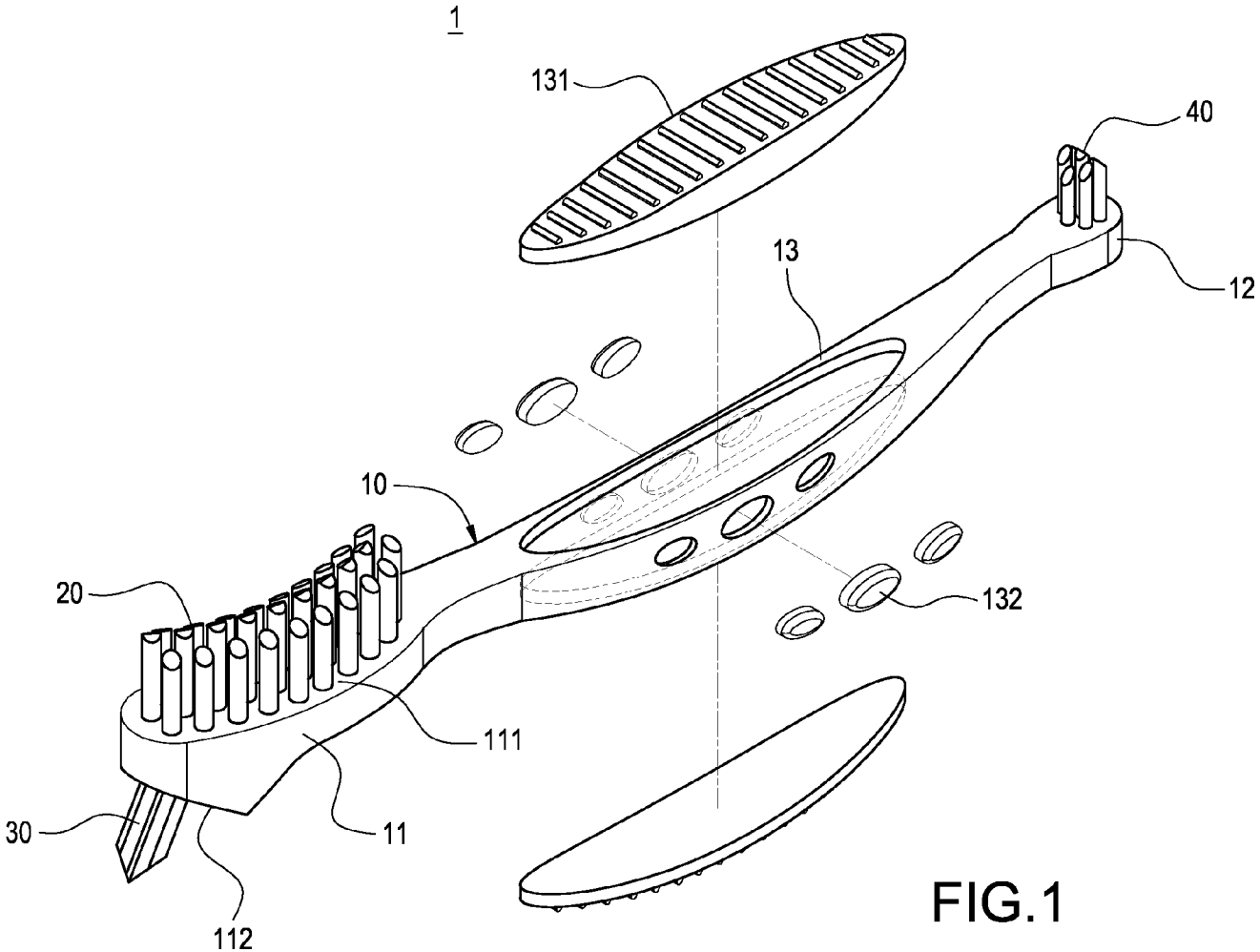
FIG. 1 is an exploded perspective view of the present invention.
Figure 2:
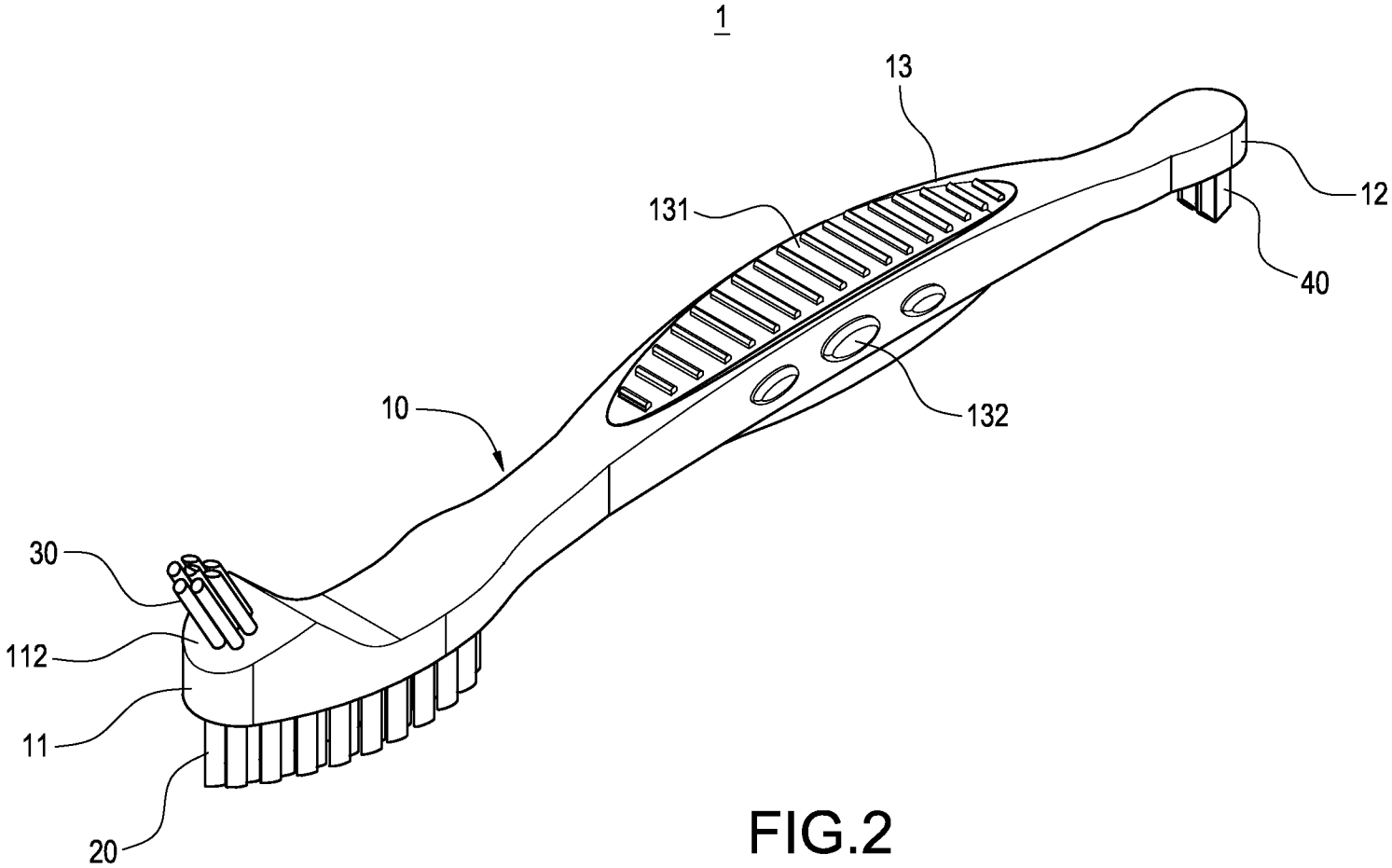
FIG. 2 is an assembled perspective view of the present invention.
Figure 3:
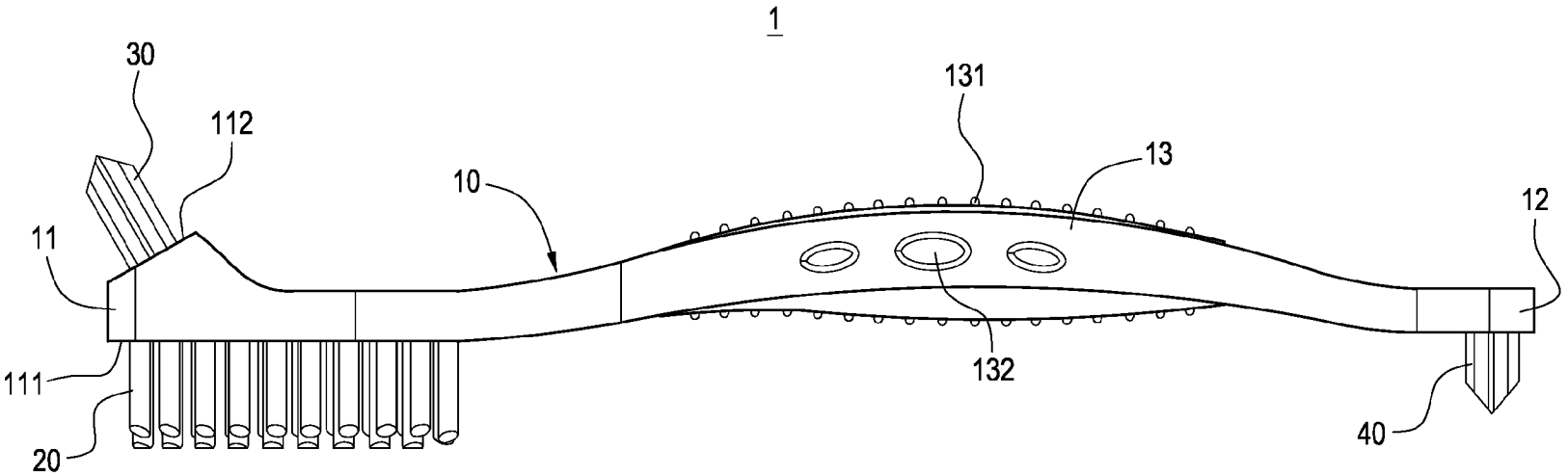
FIG. 3 is a side view of the present invention.

Please refer to FIGS. 1 to 3. The present invention relates to a multi-function brush 1 for an overdenture, which includes a brush handle 10, a first group of brushes 20, a second group of brushes 30, and a third group of brushes 40.

The brush handle 10 is molded by plastic materials and has a head end 11 and a tail end 12 counter to the head end 11. The head end 11 has a first surface 111 and a second surface 112 opposite to the first surface 111. The area of the head end 11 is larger than that of the tail end 12. The middle portion of the brush handle 10 is a grip portion 13. In order to increase the friction force when holding the brush handle 10, the outer surface of the grip portion 13 is selectively provided with a plurality of first slide-proof pads 131 and second slide-proof pads 132. As shown in FIG. 1, the first slide-proof pads 131 are provided on upper and lower surfaces of the brush handle 10 and are formed into elongate oval shapes with a larger area. The second slide-proof pads 132 are arranged in rows on side surfaces of the brush handle 10 and are formed into circular or oval shapes with a smaller area.

The first group of brushes 20 is provided on the first surface 111 of the head end 11. In the embodiment of FIG. 1, the first group of brushes 20 has three rows of brushes. The central row of brushes is taller than the rest two rows of brushes. Both side rows of brushes extend in a downward and inclined manner from the central row of brushes toward outside. Further, the three rows of brushes are arranged in a curve, thereby matching the surface configuration of the overdenture. The first group of brushes 20 has 28 bundles of brushes. The first group of brushes 20 is made of polypropylene (not limited thereto) and may have a translucent view.

The second group of brushes 30 is provided on the second surface 112 of the head end 11. As shown in FIG. 2, the second group of brushes 30 extends upwardly from the second surface 112 at an inclined angle in a leading direction of the head end 11 (i.e. away from the brush handle 10). The second group of brushes 30 has 7 bundles of brushes. The second group of brushes 30 is made of polypropylene (not limited thereto) and may have a white color.

The third group of brushes 40 is provided on the tail end 12. That is, the third group of brushes 40 is located in the same horizontal line as the first group of brushes 20. As shown in FIG. 3, the third group of brushes 40 is disposed on the tail end 12 on the same side of the brush handle 10 as the first group of brushes 20. Of course, the third group of brushes 40 may be located on the tail end 12 on the side of the brush handle 10 opposite to the first group of brushes 20 (i.e., on the same side of the brush handle 10 as the second group of brushes 30). The third group of brushes 40 is formed into a conical shape (such as a cone or prism), so that the brushes converge toward a point for easy insertion into female part of the dental attachments in natural roots or artificial roots. The third group of brushes 40 has 7 bundles of brushes. The third group of brushes 40 is made of nylon (such as nylon PA610) but not limited thereto, which is a white nylon material with excellent tuftness, low water absorption, stable dimension, good resistance to low temperature and chemical corrosion, and good electrical properties, so that it is very suitable to clean connective tissue adjacent to natural roots or artificial roots. The third group of brushes 40 may have a white color.

Figure 4:
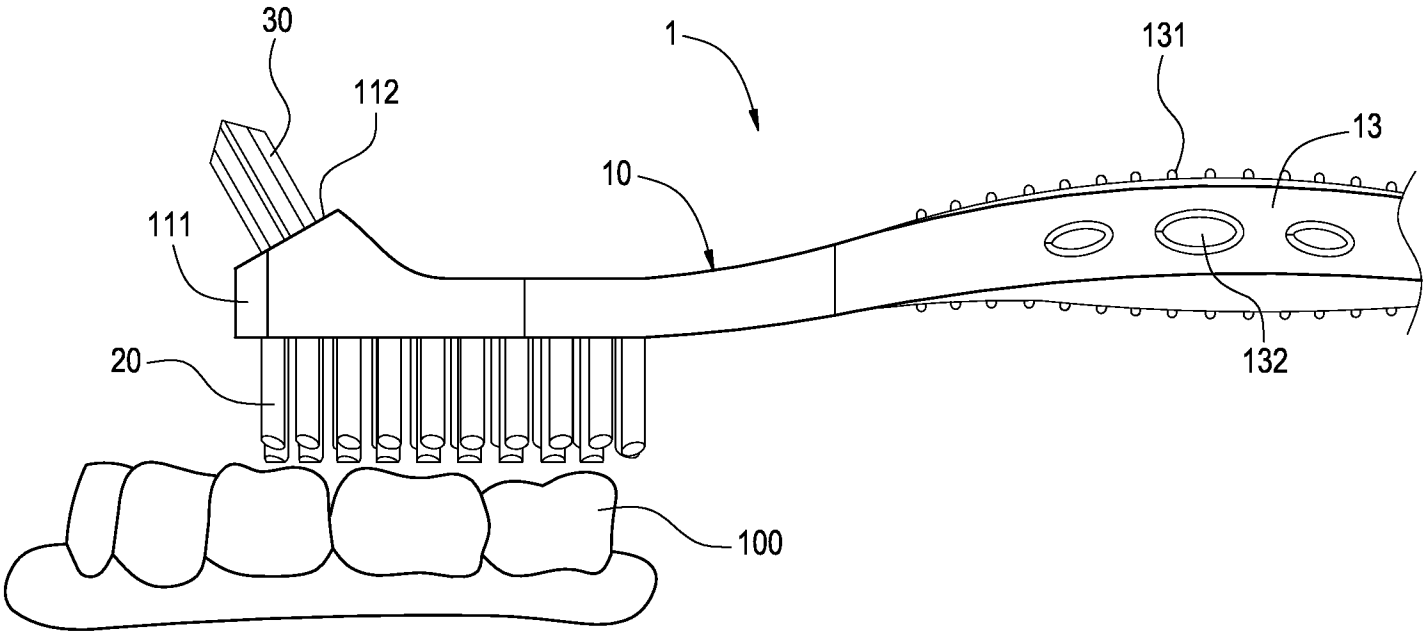
FIG. 4 is a schematic view showing that a first group of brushes of the present invention is used to clean a denture surface of an overdenture.
Figure 5:
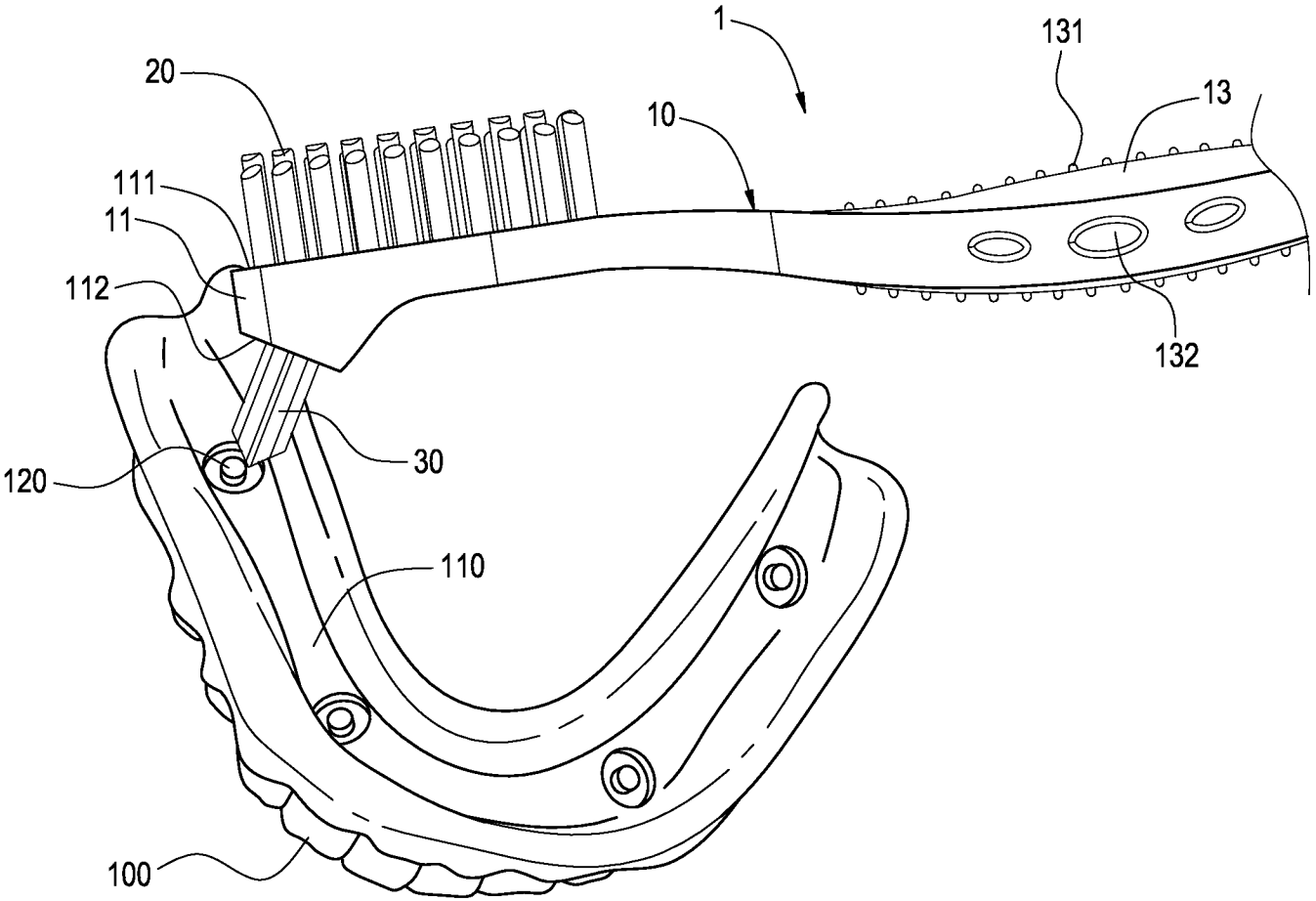
FIG. 5 is a schematic view showing that a second group of brushes of the present invention is used to clean a tissue surface of the overdenture and male part of the dental attachments provided on the tissue surface.
Figure 6:
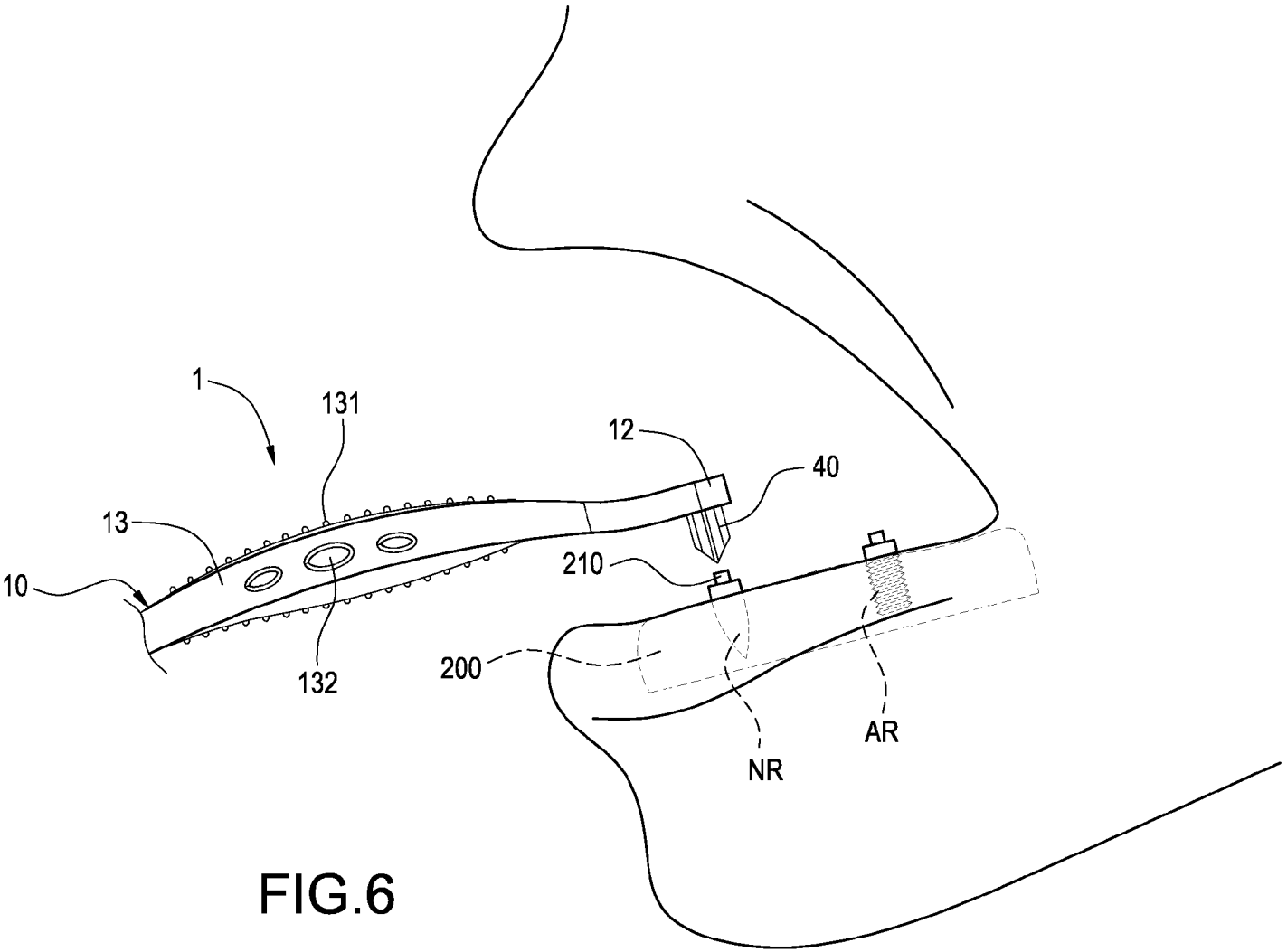
FIG. 6 is a schematic view showing that a third group of brushes of the present invention is used to clean female part of the dental attachments provided on roots.

Please refer to FIGS. 4 to 6. The operation of various groups of brushes of the overdenture brush 1 of the present invention will be described.

As shown in FIG. 4, the first group of brushes 20 is located on the head end 11 and has the largest area, which is used for cleaning the denture surface (including the occlusal surface and any resin surface) of the overdenture 100. The user takes the overdenture 100 out of the oral cavity and holds the grip portion 13 of the brush handle 10 to clean the denture surface of the overdenture 100 by the first group of brushes 20. Since the first group of brushes 20 is constituted of a protruding central row of brushes and two side rows of brushes arranged aside the central row of brushes in a downward and inclined manner, such a construction is capable of cleaning the denture surface of the overdenture 100 effectively and easily.

Please refer to FIG. 5. When the overdenture 100 is taken out of the oral cavity, the tissue surface of the overdenture 100 has a trough 110 configured to match the profile of the residual alveolar ridge 200 (referred to as "residual ridge 200" hereinafter) in the oral cavity. The trough 110 is provided therein with a plurality of male dental attachments 120. Since the trough 110 is of a small width, the first group of brushes 20 is not suitable to clean the trough 110. At this time, the user can use the second group of brushes 30 to clean the trough 110 in the tissue surface of the overdenture 100 and the male dental attachments 120 provided in the trough 110. Since the second group of brushes 30 extends from the second surface 112 in an inclined manner, such an inclined orientation makes the user to operate more ergonomically. For easy use, the first group of brushes 20 and the second group of brushes 30 are provided on the opposite surfaces of the head end 11, so that the user only needs to rotate the head end 11 of the brush handle 10.

Please refer to FIG. 6. When the overdenture 100 is taken out of the oral cavity, female dental attachments 210 provided on the residual ridge 200 to be engaged with the male dental attachments 120 are shown. The female dental attachments 210 are provided at positions where the natural roots NR or artificial roots AR are located. At this time, the user has to use the third group of brushes 40 on the tail end 12. The third group of brushes 40 is inserted into recesses (not shown) of the female dental attachment 210 easily due to its conical shape. Further, since the third group of brushes 40 is softer than the first group of brushes 20 and the second group of brushes 30, the third group of brushes 40 will not hurt the residual ridge 200 and the adjacent connective tissue at female dental attachment 210. Owing to its conical shape, the third group of brushes 40 can be inserted into the female dental attachments 210 located at the posterior molar teeth area easily.

In the above description, although the first group of brushes 20 has three rows of brushes, but it is not limited thereto. The characteristics of the present invention lies in the different locations of the first, second and third groups of brushes on the brush handle 10. The number, colors, materials, profiles of the brushes can be varied according to practical demands.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A multi-function brush for an overdenture, wherein a tissue surface of the overdenture has a trough for matching a residual alveolar ridge in an oral cavity, the trough being provided therein with a plurality of male dental attachments, the ridge being provided with a plurality of female dental attachments to be engaged with the male dental attachments, the multi-function brush including:

a brush handle having a head end and a tail end counter to the head end, the head end having a first surface and a second surface opposite to the first surface, the brush handle being molded from plastic material, an area of the head end being larger than an area of the tail end, a middle section of the brush handle being formed into a grip portion, a surface of the grip portion being provided with a plurality of first slide-proof pads and second slide-proof pads, the first slide-proof pads being provided on upper and lower surfaces of the grip portion and having a larger area than an area of the second slide-proof pads provided on side surfaces of the grip portion;

a first group of brushes provided on the first surface of the head end and being arranged for cleaning a denture surface of the overdenture;

a second group of brushes provided on the second surface of the head end and being arranged for cleaning the tissue surface of the overdenture and the male dental attachments; and a third group of brushes provided on the tail end and being arranged for cleaning a connective tissue adjacent to the ridge and the female dental attachments, the third group of brushes being softer than the first group of brushes and the second group of brushes.

2. The multi-function brush for an overdenture according to claim 1, wherein the second group of brushes extends in an angle from the second surface of the head end away from the brush handle.

3. The multi-function brush for an overdenture according to claim 2, wherein the third group of brushes is provided on the tail end on the same side of the brush handle as the first group of brushes.

4. The multi-function brush for an overdenture according to claim 3, wherein the third group of brushes is formed into a conical shape with its brushes converging into a point for easy insertion into the female dental attachments.

5. The multi-function brush for an overdenture according to claim 1, wherein the first group of brushes has three rows of brushes, a central row of brushes is taller than the rest two rows of brushes, the rest two rows of brushes are arranged aside the central row of brushes in a downward and inclined manner, the three rows of brushes are arranged in a curve to match the surface configuration of the overdenture.

* * * * *